US006730169B2

(12) United States Patent
Jahn

(10) Patent No.: US 6,730,169 B2
(45) Date of Patent: May 4, 2004

(54) ELECTROSTATIC POWER COATING SYSTEM

(75) Inventor: Walter Jahn, Rubigen (CH)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/933,936

(22) Filed: Aug. 21, 2001

(65) Prior Publication Data

US 2002/0023586 A1 Feb. 28, 2002

(30) Foreign Application Priority Data

Aug. 22, 2000 (EP) ..... 00810747

(51) Int. Cl.[7] ..... B05B 15/12

(52) U.S. Cl. ..... 118/326; 118/308; 454/50; 454/53; 427/421

(58) Field of Search ..... 118/305, 308, 118/309, 629, 634, 310, 314, 326; 454/50, 53; 427/421, 478, 479

(56) References Cited

U.S. PATENT DOCUMENTS

| | | | |
|---|---|---|---|
| 3,714,926 | A | 2/1973 | Ofner |
| 3,719,030 | A | 3/1973 | Blankenmeyer et al. |
| 3,814,002 | A | 6/1974 | Rombach et al. |

(List continued on next page.)

FOREIGN PATENT DOCUMENTS

| | | | |
|---|---|---|---|
| CH | 529590 | B | 10/1972 |
| DE | 30 28 588 | A1 | 2/1982 |
| DE | 34 08 014 | A1 | 9/1985 |
| DE | 37 15470 | A1 | 11/1988 |
| DE | 8707538 | U1 | 10/1990 |
| DE | 295 18 478 | U1 | 1/1996 |
| DE | 195 17 729 | A1 | 2/1996 |
| DE | 195 00 873 | A1 | 7/1996 |
| DE | 196 44 360 | C2 | 4/1998 |
| EP | 0 223 660 | A1 | 5/1987 |
| EP | 0 165 815 | B1 | 5/1989 |
| EP | 0 678 336 | A2 | 3/1995 |
| EP | 0 689 875 | A2 | 6/1995 |
| EP | 0 701 868 | A1 | 3/1996 |
| EP | 0 839 582 | B1 | 5/1998 |
| FR | 2 675 061 | A1 | 4/1991 |
| FR | 2 724 583 | A1 | 9/1994 |
| GB | 429028 | | 5/1935 |
| GB | 2 120 303 | A | 3/1983 |
| GB | 2 141 642 | A | 1/1985 |
| WO | 95/10365 | A1 | 4/1995 |
| WO | 99/12658 | A1 | 3/1999 |

OTHER PUBLICATIONS

International Search Report for PCT/US 00/25383.

*Primary Examiner*—Richard Crispino
*Assistant Examiner*—Michelle Acevello Lazor
(74) *Attorney, Agent, or Firm*—Calfee, Halter & Griswold LLP

(57) ABSTRACT

An electrostatic powder coating system that comprises a booth, the lower part of which is designed in the shape of a V, and a collecting channel (13), connected to a suction device (2) underneath, the booth having two ends, each of which has a pass-through opening for the workpieces. The collecting channel (13) is covered by floor plates (17), which can be walked upon or swung up into a vertical position, and which are provided with exhaust slots (18, 19, 20) extending in the longitudinal and transverse directions, it being advantageous for the total area of the slots be a function of the discharge of exhaust air and the velocity of the exhaust air.

The floor plates, which can be swung upward, improve the ability of the booth to be walked on and thus increase the ease with which the system can be serviced and operated. As a result of the way in which the exhaust slots are arranged, the powder residues can be extracted more homogeneously and uniformly and thus in optimum fashion over the entire length of the booth.

24 Claims, 3 Drawing Sheets

U.S. PATENT DOCUMENTS 3,905,785 A * 9/1975 Fabre ..... 95/280
3,918,640 A 11/1975 Piccino et al.
4,153,008 A 5/1979 Marino et al.
4,378,728 A 4/1983 Berkmann
4,409,009 A 10/1983 Lissy
4,430,956 A 2/1984 Koch, II
4,504,292 A 3/1985 Vöhringer
4,537,120 A 8/1985 Josefsson
4,704,953 A * 11/1987 Wilson ..... 454/53
4,715,314 A 12/1987 Ramseier et al.
4,770,089 A 9/1988 Vinicombe
4,926,746 A * 5/1990 Smith ..... 454/51
5,042,420 A * 8/1991 Gerdes ..... 118/50.1
5,107,756 A 4/1992 Diaz
5,153,028 A 10/1992 Shutic et al.
5,256,201 A 10/1993 Gelain et al.
5,275,634 A 1/1994 Kramer
5,346,553 A 9/1994 Pingel
5,421,885 A 6/1995 Trevisan
5,615,980 A 4/1997 Mauchle
5,681,390 A 10/1997 Lacchia
5,766,355 A * 6/1998 Josefsson et al. ..... 118/326
5,928,423 A 7/1999 Toyota et al.
6,010,571 A 1/2000 Josefsson et al.
6,461,431 B1 10/2002 Ainsworth et al.

* cited by examiner

ELECTROSTATIC POWER COATING SYSTEM

PRIORITY CLAIM

This application claims the benefit of European Patent Application No. 00810747.6 filed on Aug. 22, 2000.

FIELD OF THE INVENTION

The present invention pertains to an electrostatic powder coating system according to the introductory clause of claim 1.

BACKGROUND OF THE INVENTION

A powder coating system of this type is known from, for example, EP-B 0,200,681. Whereas the shape of this known booth brought about a considerable improvement in the collection and exhaust of the powder residues in comparison with the state of the art at the time, it was discovered when systems of this type were built that it was necessary not only to improve the accessibility of these booths to their operators but also to increase the efficiency of the powder return.

A coating system is known from U.S. Pat. No. 6,010,571, in which the powder residues drop through grates onto two channels, each of which leads to a larger channel. A gully cover which is connected to a hinge joint is known from GB-A 2,120,303.

Against the background of this known state of the art, it is the task of the present invention to improve the accessibility of booths of the general type indicated above and to increase the efficiency of the powder return. This task is accomplished by means of an electrostatic powder system according to claim 1.

The invention is explained in greater detail below on the basis of an exemplary embodiment, illustrated by drawings.

DETAILED DESCRIPTION OF THE DRAWINGS

DETAILED DESCRIPTION OF THE INVENTION

Figure 1:
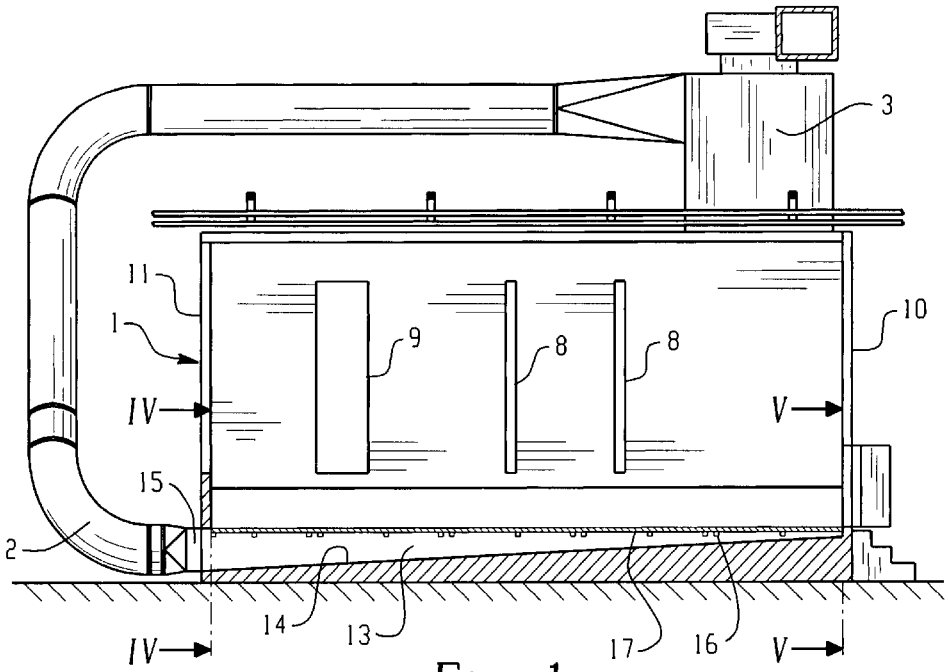
FIG. 1 shows a schematic diagram of a longitudinal section through a powder coating system according to the invention.
Figure 2:
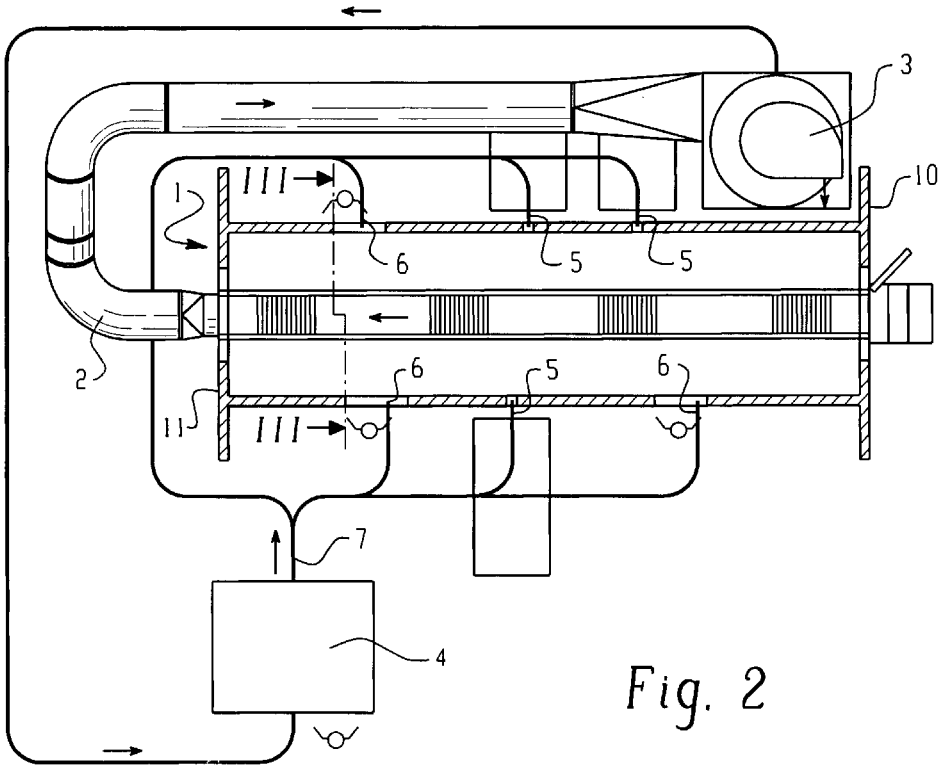
FIG. 2 is a sectional view of the system according to FIG. 1 from above.
Figure 3:
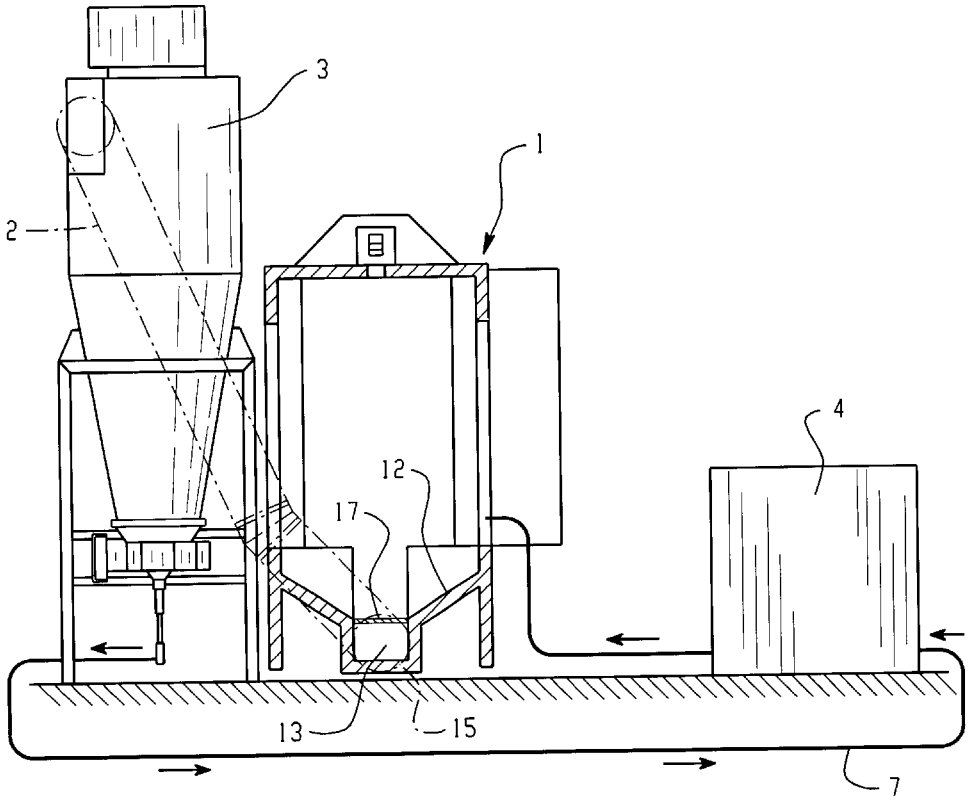
FIG. 3 is a sectional view along line III—III of FIG. 2.

In the electrostatic powder coating system according to FIGS. 1–3, we can recognize the booth 1; the exhaust device with an exhaust pipe 2, which leads to the cyclone 3; and the powder tank 4, connected to the cyclone, from which the powder is sent via a powder line 7 to the automatic spray guns 5 or hand-operated devices 6. The exhaust device is also called an absolute filter or an afterfilter by experts in the field, because it contains filters.

The booth 1 can consist of electrically nonconductive material as indicated in the above-mentioned European patent and have a cleaning system identical or similar to that described in that patent. The coating elements, such as automatic hand-operated spray guns, are assumed as known, which also applies to the exhaust pipe, the cyclone, and the powder tank with the powder feed line and the line 7 between the cyclone and the powder tank. In the cross section of FIG. 1, we also see narrower and wider openings 8 and 9, respectively; the narrower openings 8 are provided for the automatic spray devices, which are mounted on a working platform, and the larger openings 9 are provided for manual preparation work or touch-up work by means of a hand-operated spray gun.

The ends 10, 11 of the booth can be designed as a gates with double doors providing an opening, as described in the patent cited above. It is also possible, however, for the booth to have merely pass-through openings for the workpieces; that is, the booth can be produced without movable parts such as gates.

Figure 4:
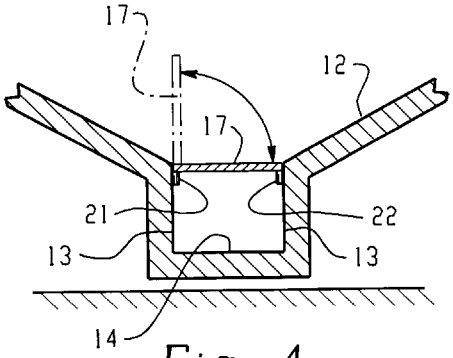
FIG. 4 is a sectional view along line IV—IV of FIG. 1 on an enlarged scale.
Figure 5:
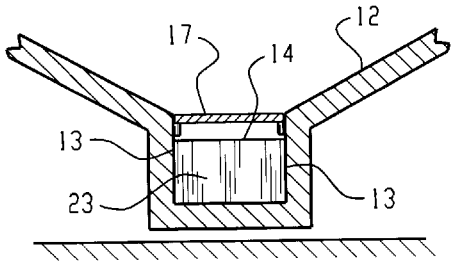
FIG. 5 is a sectional view along line V—V of FIG. 1 on an enlarged scale.

As shown in FIG. 3, the booth has a V-shaped bottom part 12, to which the collecting channel 13 is connected underneath. In this exemplary embodiment, the channel has a rectangular cross section. As can be derived from the longitudinal cross section of FIG. 1, the channel floor 14 rises at a slant from the connection 15 of the exhaust pipe toward the front, so that, as a result, uniform suction power is obtained over the entire length of the booth. In the above-mentioned European patent, this same attempt was made by giving the suction channel a variable width, as seen from above, the channel becoming wider as it proceeds from the suction pipe toward the front, but this design did not prove suitable. It can be seen in FIG. 5 that the collecting channel 13 is closed off at the front by a plate 23 and also that the open height of the collecting channel at the front is considerably smaller than it is at the connection between the channel and the suction pipe (see FIG. 4).

Figure 6:
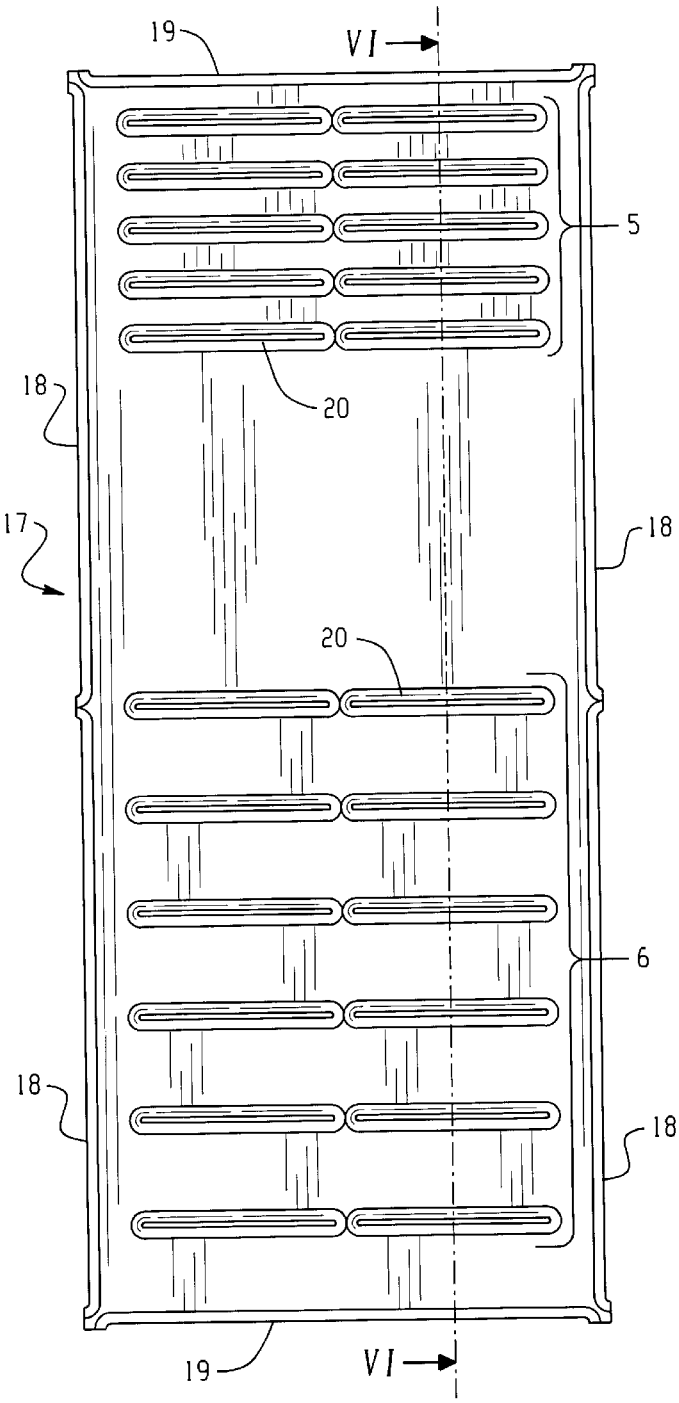
FIG. 6 is a top view of a floor plate of the system of FIG. 1.
Figure 6A:
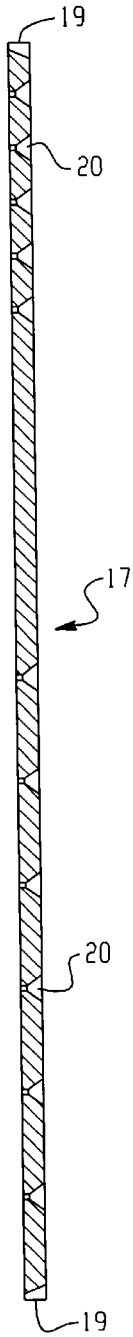

The collecting channel 13 is closed off by floor plates 17, supported along the length by holders 16, as can be seen in FIGS. 1 and 2. FIGS. 6 and 6A show a floor plate 17 in a view from above and in cross section. This floor plate is made out of a suitable, electrically nonconductive plastic material and can, for example, have a length of 1,200 mm, a width of 500 mm, and a thickness of 20 mm. Depending on the system, the floor plates can also have other dimensions and be made of some other material. The walkable floor plates are designed to be stable enough that they can support the weight of worker; the indicated dimensions easily fulfill this requirement.

To guarantee that the powder residues, which are not distributed uniformly over the entire floor of the booth but which are rather more concentrated in the area of the automatic spray guns and less concentrated in the area of the manual preparation and touch-up work, are exhausted with maximum efficiency, various slots and slot arrangements are provided in the floor plate or plates. Thus, for example, one floor plate has slots 18 along both longitudinal sides and intermediate slots 19 along both transverse sides, and additional transverse slots 20 in the interior of the floor plate. The transverse slots 20 are not distributed uniformly over the plate or distributed uniformly over several plates but rather are more concentrated in the areas 5 of the automatic spray guns and less concentrated in the areas 6 of manual processing.

The longitudinal slots 18 play a greater role in homogeneous extraction over the entire length of the booth than the transverse slots 19, 20, which can also be arranged at an angle to the longitudinal axis. In addition, especially in the case of smaller booths, the transverse or slanted slots can be replaced by just a few openings or possibly by one opening in a plate or in several plates.

In regard to the layout of the slots, i.e., their frequency and width, it is advantageous to design them in such a way that the total open surface area of the slots results in a velocity of the exhaust air flow produced by the afterfilter, which makes maximum powder return possible. At a desired flow velocity of 16 m/s and a discharge of exhaust air of 4.444 $m^3/s$, a total open surface area for the slots of 0.278 $m^2$ is obtained. That means that, by means of a simplified calculation, the discharge of exhaust air in $m^3/s$, divided by the desired, optimum flow velocity in m/s, gives the desired total area of the slots of one web.

An exhaust slot arrangement on a floor plate of this type and the arrangement of the floor plates according to FIGS. 1 and 2 make possible a homogeneous, uniform, and optimum exhaust of the powder residues over the entire length of the booth during operation, this being accomplished at high exhaust outputs.

To clean the collecting channel, the floor plates must be removed. According to FIG. 4, it is possible to swing the floor plate up into a vertical position and to hold it in this vertical position by means of the retaining part 21 of the holder 16. It is also possible to remove the plate entirely. In the folded-down state, it rests on the support part 22. It is also possible to attach hinges at the locations of the retaining parts.

Although one embodiment of this invention has been shown and described, various adaptations and modifications can be made without departing from the scope of the invention as defined in the appended claims.

I claim:

1. A powder coating system booth comprising, vertical walls with two lower downwardly slanted side portions, and a collecting channel duct connected to an exhaust device, said channel duct extending lengthwise end to end across the booth, said collecting channel being covered by at least one floor plate, said floor plate being provided with exhaust slots arranged at least along both long sides and with at least one exhaust slot in the Interior of the floor plate, said at least one exhaust slot in the interior of the floor plate being specifically disposed to produce a desired air flow pattern, said channel duct having a sloped channel floor that rises from one end thereof to an opposite end thereof.

2. The system according to claim 1, wherein the total area of the slots and openings in the floor plate is a function of the flow velocity of the exhaust air and the discharge of exhaust air, where the discharge of exhaust air in $m^3/s$, divided by the flow velocity in m/s, gives the total open area in $m^2$.

3. The system according to claim 1, wherein the floor plate can be removed or swung up and held in place in any position.

4. The system according to claim 1, wherein the floor plate is provided with longitudinal exhaust slots along both long sides, with transverse intermediate slots along both transverse sides, and additional transverse or slanted exhaust slots, which are arranged more or less closely together according to where the powder collects in greater or lesser concentrations.

5. The system according to claim 1, wherein the height of the collecting channel floor, seen in longitudinal cross section, decreases as it extends away from the connection of the exhaust pipe.

6. A powder coating spray booth comprising vertical booth walls with two lower downwardly slanted side portions and a collecting channel duct below and between said slanted side portions and extending lengthwise end to end in the boot; said collecting channel duct being connected at an exhaust end to a powder overspray collector, said overspray collector producing a suction that draws powder overspray from within the booth trough said collecting channel duct into said overspray collector; said collecting channel duct comprising at least one floor plate as a cover that extends end to end across said channel duct to substantially enclose said collecting channel duct, there being at least one slot through said floor plate, said at least one slot being specifically arranged to produce a desired air flow pattern into said collecting channel dud and to allow overspray powder to enter said collection channel duct and to be drawn into said overspray collector through said channel collecting duct.

7. The booth of claim 6 wherein said overspray collector comprises a cyclone.

8. The booth of claim 7 wherein said cyclone is connected to an after filter fan.

9. The booth of claim 6 wherein said collecting channel duct comprises a channel floor that rises at a slant from said exhaust end to an opposite end thereof.

10. The booth of claim 6 wherein said slot extends along a lengthwise side of said collecting channel duct.

11. The booth of claim 10 comprising two slots along respective lengthwise sides of said collecting channel duct.

12. The booth of claim 6 wherein said slot is formed in said floor plate.

13. The booth of claim 12 comprising a plurality of said slots formed in said floor plate transverse a lengthwise axis of the booth.

14. The booth of claim 13 wherein said slots are formed in said floor plate at positions along said axis corresponding to spray gun locations.

15. The booth of claim 6 wherein said floor plate supports a person's weight for walking thereon.

16. The booth of claim 6 wherein said floor plate comprises a plurality of sections.

17. The booth of claim 16 wherein each said section is separately moveable for cleaning a corresponding portion of said collecting channel duct.

18. The booth of claim 17 wherein each said section is hinged.

19. The booth of claim 6 wherein said floor plate is moveable to permit said collecting channel duct to be cleaned.

20. The booth of claim 6 wherein said floor plate is hinged.

21. The booth of claim 6 comprising at least one slot formed in said floor plate, wherein a total area of said slots is a function of a discharge rate of air exhausted by said overspray collector and the flow velocity of air into said collecting channel duct.

22. The booth of claim 21 wherein said discharge rate is in units of $meters^3$/second and said flow velocity is in units of meters/second, such that said total area is a function of the ratio of said discharge rate to said flow velocity.

23. The booth of claim 6 wherein slats are provided in selected locations such that more powder is collected into said collection channel duct near booth locations corresponding to positions of automatic spray guns.

24. The booth of claim 6 comprising an angled slot formed in said floor plate wherein said angled slot extends at a non-transverse angle to said longitudinal axis.

* * * * *